United States Patent [19]

Stevenson

[11] Patent Number: 4,830,790

[45] Date of Patent: May 16, 1989

[54] FOAM GENERATING NOZZLE

[75] Inventor: Douglas E. Stevenson, Ottawa, Canada

[73] Assignee: Co-Son Industries, Gloucester, Canada

[21] Appl. No.: 116,544

[22] Filed: Nov. 4, 1987

[51] Int. Cl.[4] ..... B01F 3/04

[52] U.S. Cl. ..... 261/18.1; 169/15; 239/428.5; 239/431; 239/432; 261/DIG. 26

[58] Field of Search ..... 261/DIG. 26, 18.1; 169/15; 239/428.5, 431, 432

[56] References Cited

U.S. PATENT DOCUMENTS

| | | | |
|---|---|---|---|
| 2,386,918 | 10/1945 | Timpson | 261/DIG. 26 |
| 2,388,508 | 11/1945 | Timpson . | |
| 2,513,417 | 7/1950 | Lindsay . | |
| 2,603,469 | 7/1952 | Bedford et al. | 261/DIG. 26 |
| 2,837,323 | 6/1958 | Goodrie | 239/428.5 |
| 3,419,082 | 12/1968 | O'Regan et al. | 261/DIG. 26 |
| 3,701,482 | 10/1972 | Sachnik . | |
| 3,713,591 | 1/1973 | Watkins | 239/590.3 |
| 3,831,860 | 8/1974 | Gullaksen et al. | 239/500 |
| 3,941,314 | 3/1976 | Moss et al. | 239/553.3 |
| 4,214,702 | 7/1980 | Shames et al. | 239/428.5 |
| 4,330,086 | 5/1982 | Nysted | 239/8 |
| 4,403,739 | 9/1983 | Knapp et al. | 239/428.5 |
| 4,637,552 | 1/1987 | Finkbeiner et al. | 239/428.5 |

FOREIGN PATENT DOCUMENTS

| | | | |
|---|---|---|---|
| 130515 | 1/1911 | Canada . | |
| 490113 | 2/1953 | Canada . | |
| 1040877 | 10/1953 | France | 169/15 |
| 1058313 | 3/1954 | France | 169/15 |
| 54162 | 2/1943 | Netherlands | 261/DIG. 26 |
| 2034189 | 6/1980 | United Kingdom | 261/DIG. 26 |

*Primary Examiner*—Tim Miles

*Attorney, Agent, or Firm*—Nixon & Vanderhye

[57] ABSTRACT

A foam generating nozzle construction, and method of use is disclosed, wherein a tubular nozzle body, with an inlet and outlet has turbulence inducing means in the form of contiguous transverse apertured plates preceding air aspirating means. A pressurized mixture of water and foaming agent enters the nozzle and diverges through a first set of apertures in an obstructing plate, then converges through a contiguous plate with a central aperture partially overlying the first set of apertures to create a turbulent spray which then entrains air from aspiration holes to produce a low or medium expansion foam with an enhanced drain time.

10 Claims, 2 Drawing Sheets

FOAM GENERATING NOZZLE

BACKGROUND AND SUMMARY OF THE INVENTION

The present invention relates to a foam generating nozzle for use in fire fighting or related applications. More particularly, the invention relates to a lightweight nozzle with a central bore or passage having transverse means to create a turbulent, air entraining flow within the fluid passing through the nozzle.

Foam generating nozzles may be used in fire fighting as well as in other foam applications, such as protective coverings for plants. Foams used in fine fighting have different characteristics, depending on the type of fire. Foam used on a Class B flamable liquid fire must blanket and suffocate the first whereas when fighting a Class A fire in ordinary material foams require a quenching ability in addition.

To extinguish a Class A fire, desirably the foam generated by a nozzle should have a low expansion ratio and a long drain or dwell time to enhance the effectiveness of the foam. Foams having a low expansion will drain less rapidly from a surface which has been covered, and will adhere for a sufficient time to vertical surfaces to accomplish the necessary level of quenching or insulation. Class B fires, on the other hand, are better controlled by a medium expansion foam, with a higher density bubble matrix to suffocate the fire.

In order to develop a foam, it is necessary to achieve a turbulent interaction of the fire fighting fluid medium, usually water, a foaming agent, and a gas, usually ambient air. Many factors appear to affect the foam characteristics, including the proportions of foaming agent in water, the amount and location of air applied to the foam and, to a large measure, the structure and degree of turbulent interaction of the mixture of water and foaming agent with the air.

Previous foam generating nozzles have utilized heavy metal structures with complex apertures and passages therein.

U.S. Pat. No. 2,388,508 to Timpson discloses a nozzle with a central valve body having a pair of converging ducts or passages to cause two streams of the liquid mixture to impinge at a 60° angle within a cylindrical baffle or spray straightner, before exiting into a low pressure air chamber which then feeds foam through a throat and pattern nozzles.

U.S. Pat. No. 2,513,417 to Lindsay discloses a complex nozzle with a venturi means for feeding foaming agent into the water, with a conical spreader which separates the stream of mixture in an air chamber. A further tear drop shaped baffle is required to control the velocity of the fluid to achieve a more uniform foam quality.

Both of the foregoing patents require a complex machined or cast product with specially designed fluid passages to generate an adequate foam.

The present invention, however, has achieved improved foam characteristics, both in drain time and adherence, with no increase in complexity or weight of materials. Rather, significant simplification of design has resulted in surprisingly economical manufacturing capabilities while achieving even lighter weights and improved fire fighting capabilities.

The present invention of a foam generating nozzle has a nozzle body with a longitudinal passage therethrough, an inlet at the up-stream end of the nozzle body for receiving a pressurized mixture of water and foaming agent, an outlet at the down-stream end of the nozzle body for emitting a stream of foam, a plurality of contiguous apertured plates positioned transversely across the passage between the inlet and outlet to permit passage of the mixture through the nozzle, wherein at least one plate has at least one aperture and at least one other plate has a plurality of apertures partially overlying a portion of the at least one aperture to permit passage of the mixture therethrough; and means downstream of said plates for the induction of air into the interior of the nozzle.

It is an object of the present invention to provide a simplified nozzle structure allowing for economical and efficient manufacture, while also achieving a desirable light weight and durability.

A further object of the invention is to provide a nozzle which will generate a low to medium expansion foam with an extended drain time while retaining good range or throw characteristics.

The nature and objects of the invention and the various advantageous features are shown in the accompanying drawings illustrating preferred forms by way of example.

Figure 1:
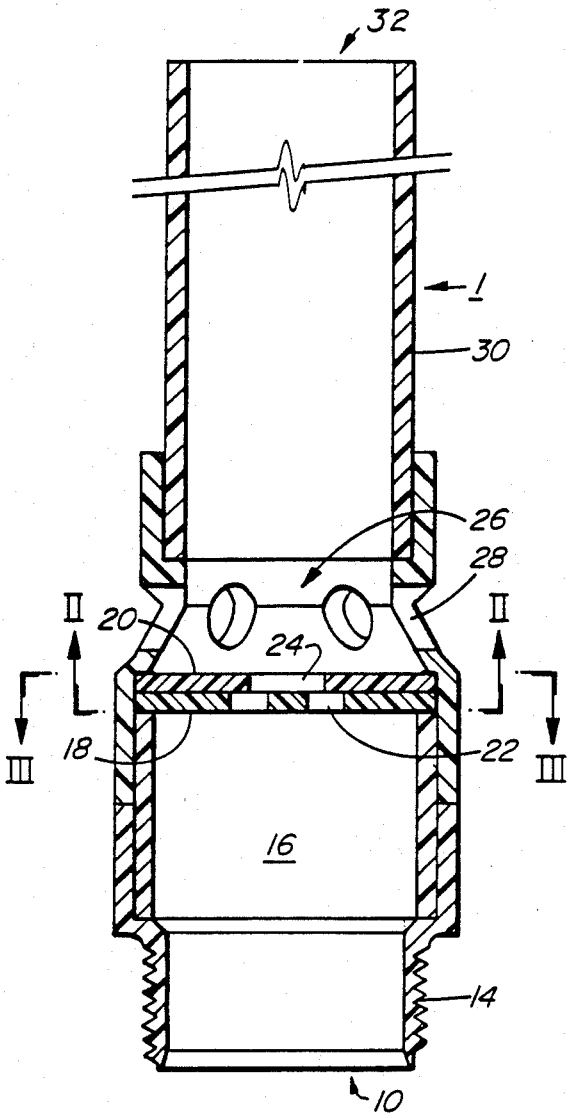
FIG. 1 is a longitudinal cross-sectional view of a foam generating nozzle illustrating the principles of the present invention.

The present invention will be explained in relation to FIG. 1 which illustrates one embodiment of the invention which achieves the objects of the invention.

Figure 2:
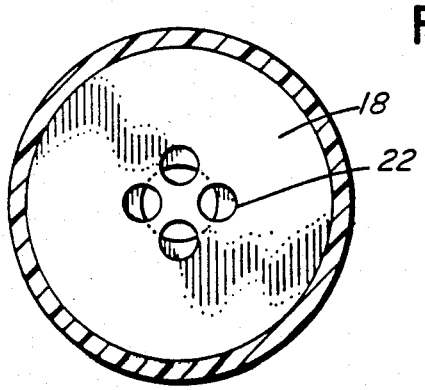
FIG. 2 is a cross-sectional view of the turbulence generator of the nozzle taken along the line 2—2 of FIG. 1.
Figure 3:
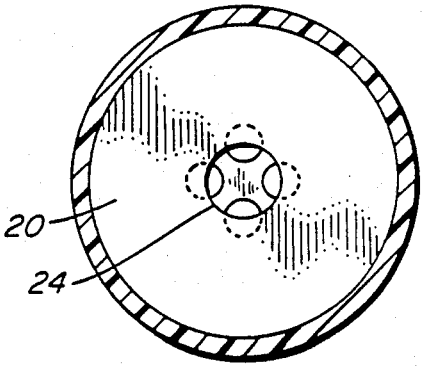
FIG. 3 is a cross-sectional view of the turbulence generator of the nozzle taken along the line 3—3 of FIG. 1.

A tubular nozzle body, generally illustrated as 1, has a circular inlet 10 and a circular outlet 20. A source of pressurized fluid and foaming agent is supplied to inlet 10. Commonly, a mixture of water and foaming agent such as Silv-Ex* or Monsanto WD861 is supplied under pressures ranging from 50 to 200 pounds per square inch via a 1½ inch fire hose. The hose is attached at inlet 10 by any standard coupling such as by threads 14. The pressurized mixture passes through inlet 10 into tubular chamber 16 until obstructed by a turbulence generator comprising a pair of contiguous transverse plates 18 and 20. Plate 18 comprises a diverter disc with a plurality of circular apertures 22, which is in face to face contact with plate 20 being a converter disc with a single centrally located aperture 24. The plates or discs 18 and 20 are of a generally equal thickness, no greater than and preferably less than the diameter of the apertures 22. As illustrated in FIGS. 2 and 3 apertures 22 are generally centered symmetrically on the circumference of aperture 24, but may be offset outwardly up to ⅓ of their radius without significant diminution of nozzle performance. Thus, manufacturing tolerances will permit reasonable dimensional variation without significant degradation of performance.

* TM of Wormald CDN

Desirably, the cross-sectional area of aperture 24 is approximately equivalent to the total cross-sectional areas of apertures 22, and is determined on the basis of the pressure available for supply of mixture to the nozzle and the flow rate desired from the nozzle.

When the mixture of water and foam generating agent passes from chamber 16 through the turbulence generated it is diverted through apertures 22 and divided into a number of streams. It is believed that a portion of the mixture in each stream impinges against the up-stream surface of disc 20 which partly overlies apertures 22, thereby generating back pressure and significant turbulence. The streams of mixture escape laterally into apertures 24 and appear to converge in some observable degree.

Upon exiting through aperture 24, the converging streams of mixture interact and expand into multiple turbulent finely divided sprays within aspirating zone 26. A series of radial apertures 28 circumscribe barrel 30 of the nozzle at a point approximately one third of the barrel diameter down-stream from the plates. The mixture entering zone 26 creates a reduced aspirating pressure to draw ambient air through aspiration holes 28 to interact with the turbulent mixture. The consequence of the interaction of aspirated air with the turbulent mixture results in the production of a quality foam bubble structure which fills barrel 30 shortly down-stream of the aspiration holes 28. The foam then exits barrel 30 at outlet 32 under pressure.

It has been found that the length of barrel 30 is not critical, although desirably the barrel should exceed three times its diameter in order to allow full foam formation and expansion before ejection from the nozzle exit. In contrast, excessive barrel length is undesirable as friction losses between the foam and the side of the barrel will reduce the pressure in the foam exiting the nozzle, thereby reducing the throw characteristics of the foam stream.

The parameters of nozzles fulfilling the objects of the invention are illustrated by example hereafter.

EXAMPLE 1

A medium flow capacity nozzle was constructed with the following parameters.

Inlet diameter—1½ inches
Barrel diameter—1¼ inches
Barrel length—12 inches
Disc diameters—1½ inches
Diverter disc—4×¼ inch diameter holes symmetrically centered on circumference of converter disc hole
Converter disc—central ½ inch diameter hole
Aspiration holes—6×⅜" diameter, ½" from discs
Pressure—70 p.s.i.
Flow Rate—16 imperial gallons per minute A high quality 10 to 1 expansion foam was generated with a 25 percent drain time of 12 minutes tested in accordance with N.F.P.A. 412 Foam Standard. The foam was applied to a vertical surface with insignificant slump when applied in thicknesses varying from ½ inch to 2 inches.

With operating pressures at 70 p.s.i., 16 imperial gallons of fluid produced 160 imperial gallons of foam per minute with a throw distance or reach of stream of 80 feet.

EXAMPLE 2

Inlet diameter—1½ inches
Barrel diameter—1½ inches
Barrel length—14 inches
Disc diameters—1½ inches
Diverter disc—4×5/16 inch diameter holes symmetrically centered on circumference of converter disc hole
Converter disc—central ⅝ inch diameter hole
Aspiration holes—6×½" diameter, ½" from discs
Pressure—70 p.s.i.
Flow Rate—32 imperial gallons per minute The nozzles of Examples 1 and 2 were constructed of light-weight ABS tubing with standard plumbing connections. It has been found that such construction has the advantage of light-weight, durability and readily obtainable, economically priced parts.

In operation, the nozzle will throw a stream of foam a distance varying up to 85 feet. Where the fluid delivery passage is high, and it is not desired to throw a stream of foam to maximum range, the range of throw can be reduced simply by manually covering one or more of the aspiration apertures. Such choking will result in a dramatic ability to reduce and control the range of throw while maintaining a consistent quality of foam.

Figure 4:
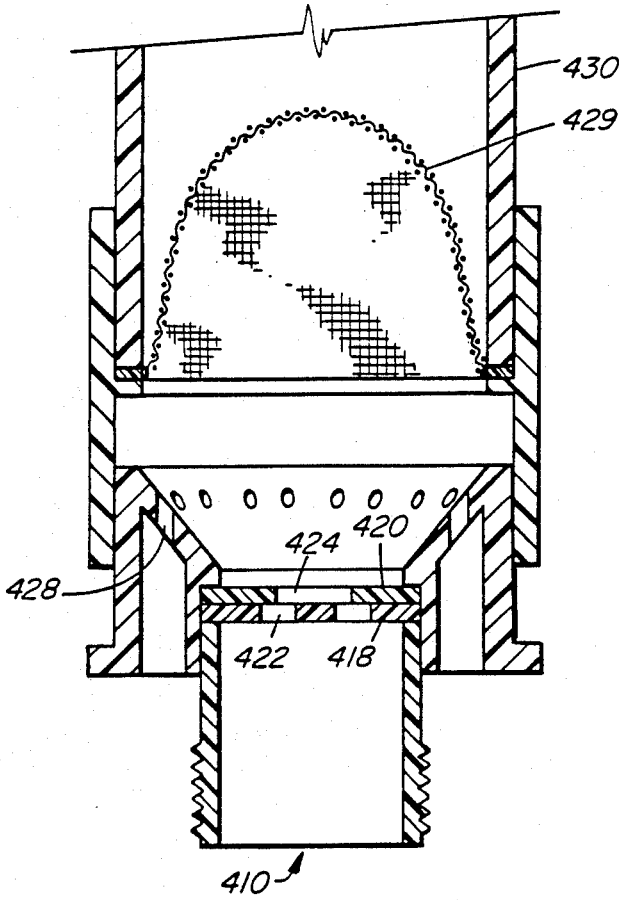
FIG. 4 is a longitudinal sectional view of an alternate embodiment of a nozzle utilizing the invention.

Referring now to FIG. 4, an alternate embodiment of the invention is illustrated wherein threaded inlet portion 410 is adapted to receive a fire fighting mixture of water and foaming agent under pressure which then passes through the multiple orifices 422 of diverter disc 418 and then exits through orifice 424 of the converter disc 420. Upon exiting from the orifice, the turbulent mixture generates a low pressure which aspirates air through orifice 428. Optionally, in order to obtain a finer bubble matrix in the foam, a screen or mesh 429 may be inserted in barrel 430.

EXAMPLE 3

Inlet diameter—1½ inch with fire hose threaded connection
Barrel—14 inches by 3 inch diameter
Disc diameters—1½ inches
Diverter disc—4×5/15 inch diameter holes symmetrically centred on circumference of converter disc hole
Converter disc—central ⅝ inch diameter hole
Aspirator holes—18×3/16 inch diameter
Pressure—85 psi
Rate—32 gallons per minute At a pressure of 85 psi, this nozzle produced a medium expansion foam at a flow rate of 32 gallons per minute, producing 320 gallons per minute of foam with a reach of 50 feet. The reach of foam was not as great as examples 1 and 2, due in part to the provision of a screen corresponding to screen 429, but a finer bubble matrix was achieved with the screen, resulting in a 25% drain time in excess of 15 minutes.

Figure 5:
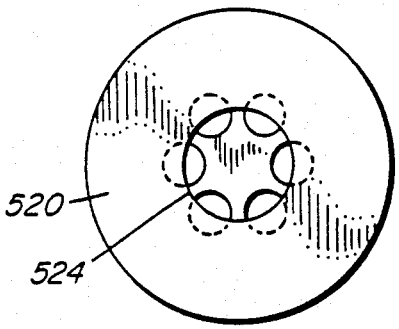
FIG. 5 is a plan view of an alternate configuration of the turbulence generator plate of the invention.
Figure 6:
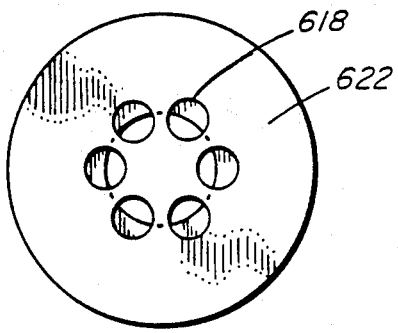
FIG. 6 is the opposite plan view of the plate of FIG. 5.

An alternate embodiment of turbulence generator from plates 18 and 20 may be seen in FIGS. 5 and 6. Turbulence generator 520 may be a unitary plate element in which a larger hole 524 is formed partially through the plate, and a number of smaller holes 618 are similarly formed in the up-stream surface of the plate (See FIG. 6). Holes 524 and 618 partially penetrate the plate from opposite sides, and intersect at a plane intermediate surfaces 520 and 622, providing turbulence generating passages for the mixture.

Additionally different combinations of apertures may be utilized in the turbulence generator, such as the six holes 618 overlying the central hole 524 shown in FIGS. 5 and 6. Similar holes can be provided in converter and diverter plates 18 and 20.

With any combination of apertures it is desirable to maintain a correlation between the total cross-sectional area of the diverter plate apertures equal to the cross-sectional area of the orifice of the converter plate. In any event, maximum efficiency of the nozzle is achieved where the diverter plate orifices are centered on the circumference of the converter plate orifice without variation greater than ⅓ of the radius of the converter plate orifice.

Further variations in the lay-out of the orifices of the converter and diverter plates may be achieved by utilizing more than one orifice in the converter plate and grouping the orifices of the diverter plate symmetrically overlying the circumferences of the converter plate orifices.

The embodiments shown and described above are only exemplary. Various modifications can be made in the construction, materials, arrangement and operation of the nozzle and still be within the scope of the invention. The limits of the invention and the bounds of the patent protection are measured and defined by the following claims.

The embodiments of the invention in which an exclusive property or privilege is claimed are defined as follows:

1. A nozzle adapted to generate aerated foam, said nozzle having a nozzle body with a longitudinal passage therethrough, an inlet at the up-stream end of the nozzle body for receiving a pressurized mixture of water and foaming agent, an outlet at the down-stream end of the nozzle body for emitting a stream of foam; a pair of contiguous relatively thin apertured plates positioned transversely across the passage between the inlet and outlet to permit passage of the mixture through the nozzle, wherein the up-stream plate has a plurality of spaced smaller apertures and the other plate has one larger central aperture, with the plurality of smaller apertures each partially overlying by less than one half a portion of the larger aperture whereby the flows of mixture from each smaller aperture are deflected into a convergent turbulent stream by the overlapping plate; and means down-stream of said plates for the induction of air into the interior of the nozzle.

2. The nozzle of claim 1 wherein the up-stream plate has a plurality of circular holes, and the other plate has a single central circular hole wherein the centers of the plurality of holes generally coincide with the circumference of the single hole.

3. The nozzle of claim 1 wherein the up-stream plate has a plurality of circular holes, and the other plate has a single central circular hole wherein the centers of the plurality of holes lie outside the circumference of the single hole by up to one third the radius of the smaller holes.

4. The nozzle of claim 2 or 3, wherein the area of the single hole in the other plate is generally equal to the cross-sectional areas of the plurality of holes in the up-stream plate.

5. The nozzle of claim 2 wherein the upstream plate has four symmetrical holes and the diameter of the single hole in the other plate is generally twice the diameter of the holes in the upstream plate.

6. The nozzle of claim 4, wherein the upstream plate has symmetrical holes of equal diameter.

7. A nozzle adapted to generate aerated foam, said nozzle having a nozzle body with a longitudinal passage therethrough, an inlet at the up-stream end of the nozzle body for receiving a pressurized mixture of water and foaming agent, an outlet of the down-stream end of the nozzle body for emitting a stream of foam, a pair of relatively thin apertured plates positioned in close juxtaposition transversely across the passage between the inlet and outlet to permit passage for the mixture through the nozzle, wherein one plate is an up-stream diverter plate having a plurality of smaller apertures and the other plate is a down-stream converter plate having a single larger central aperture partially overlying by less than one half the smaller apertures, and at least one aeration orifice down-stream of the plates for the induction of air into the interior of the nozzle.

8. The nozzle of claim 7, wherein the one plate has four symmetrical apertures and the diameter of the single aperture in the other plate is generally twice the diameter of the apertures in the one plate.

9. The nozzle of claim 7, wherein the area of the single aperture in the other plate is generally equal to the cross-sectional areas of the plurality of apertures in the one plate.

10. The nozzle of claim 9, wherein the one plate has symmetrical apertures of equal diameter.

* * * * *